United States Patent [19]

Pender

[11] 3,982,732

[45] Sept. 28, 1976

[54] APPARATUS FOR TRANSPORTING AND ERECTING MODULAR HOUSING SYSTEM

[76] Inventor: David R. Pender, 1018 Marion St., Columbia, S.C. 29201

[22] Filed: Oct. 9, 1974

[21] Appl. No.: 513,215

Related U.S. Application Data

[62] Division of Ser. No. 395,517, Sept. 10, 1973, Pat. No. 3,881,283.

[52] U.S. Cl. ..... 254/139.1; 52/745; 212/48; 214/1 H; 294/67 R

[51] Int. Cl.[2] ..... B66C 23/00

[58] Field of Search ..... 212/47, 48, 49, 9, 144; 214/1 H, 1 SW; 254/139.1; 52/745, 79; 294/67 R, 81 R

[56] References Cited

UNITED STATES PATENTS

| | | | |
|---|---|---|---|
| 3,556,580 | 1/1971 | Bridge | 294/81 SF |
| 3,831,770 | 8/1974 | Gottlieb et al. | 52/745 |
| 3,868,023 | 2/1975 | Willingham | 212/144 |

OTHER PUBLICATIONS

Engineering News-Record by John H. Sawkins entitled "Cranes Move Twenty-Five Ton Wooden Building Half A Mile," p. 986, vol. 79, No. 21.

*Primary Examiner*—Robert J. Spar
*Assistant Examiner*—Lawrence J. Oresky
*Attorney, Agent, or Firm*—B. P. Fishburne, Jr.

[57] ABSTRACT

Essentially L-shaped housing modules used to construct a multi-level apartment building are transported to an erection site on a flat bed trailer drawn by a winch-equipped towing truck. An identical truck is used to tow a construction crane tower to the site on a trailer vehicle which is later utilized as a counterweight for a simplified fixed radius non-rotating crane based on one of the trucks and erected by use of the second truck. Twin opposing cranes are employed to lift and manipulate housing modules at the site. A special lifting truss with hinged transverse extensions is employed in conjunction with the twin cranes and has means for coupling to each housing module so as to add to the rigidity of the latter. Worker platforms on the crane towers have manual winch means for making fine adjustments in the attitude of each module so that the module can be correctly set into place on underlying modules or on a prepared foundation.

7 Claims, 19 Drawing Figures

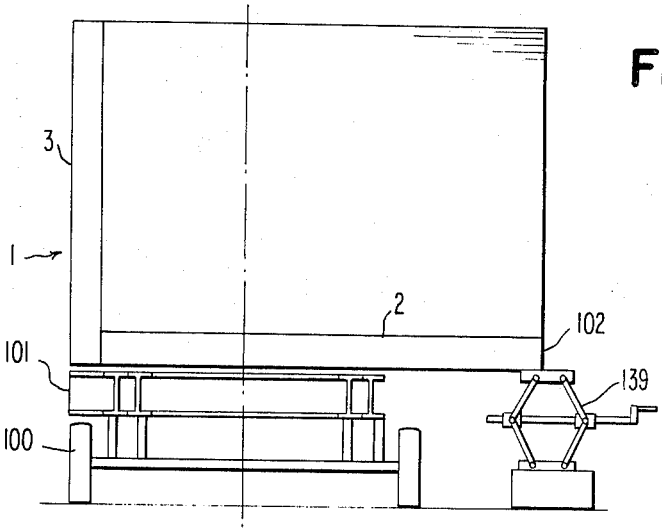
FIG.1
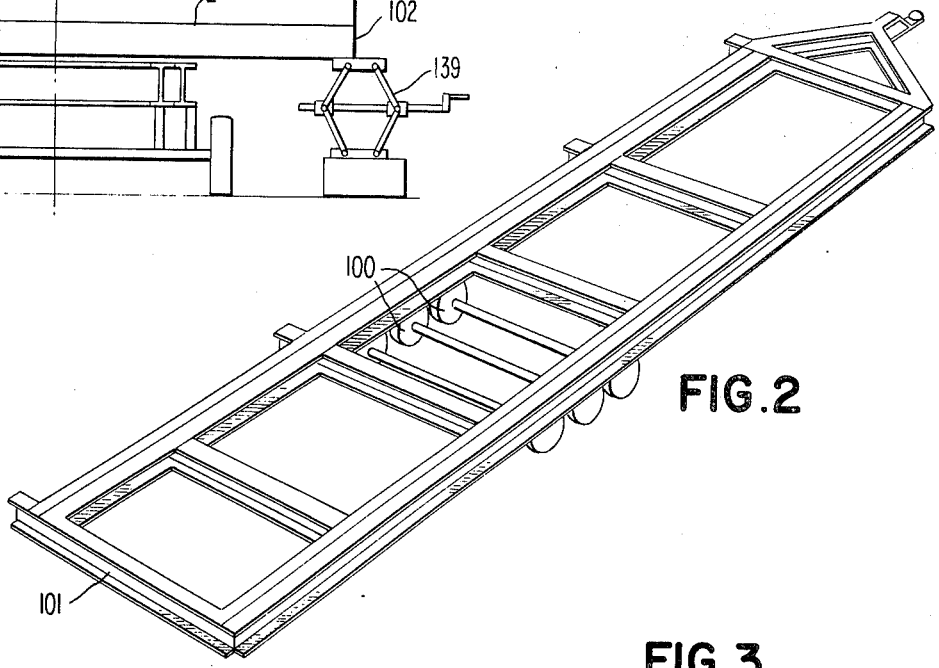
FIG.2
FIG.3
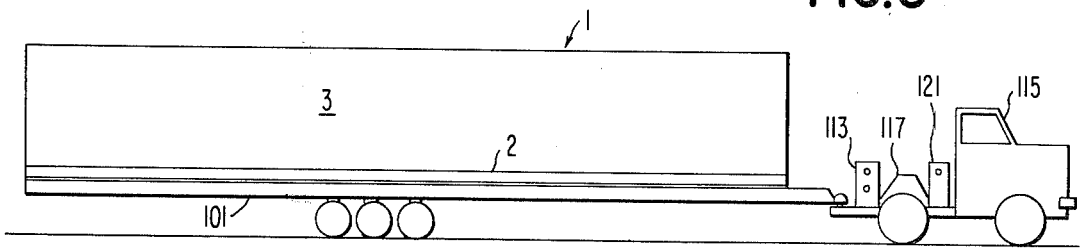
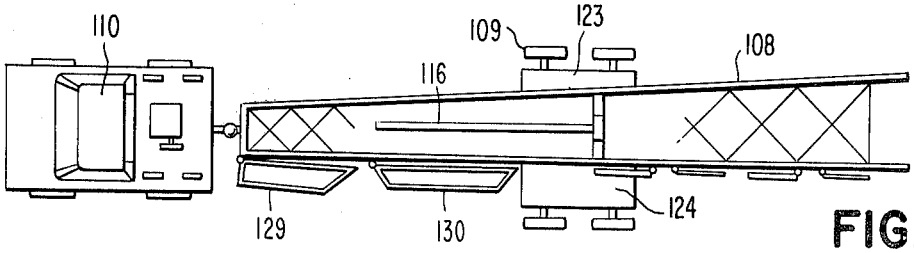
FIG.4
FIG.5
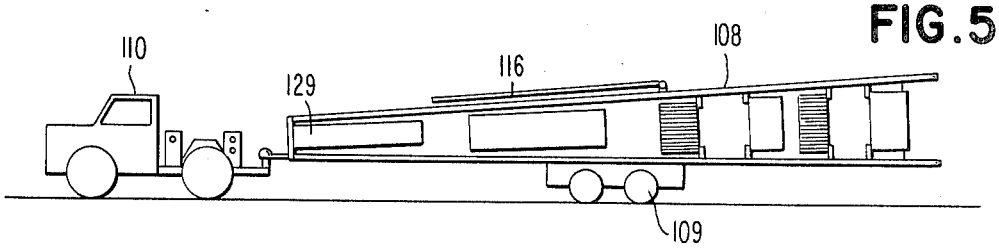

FIG.11
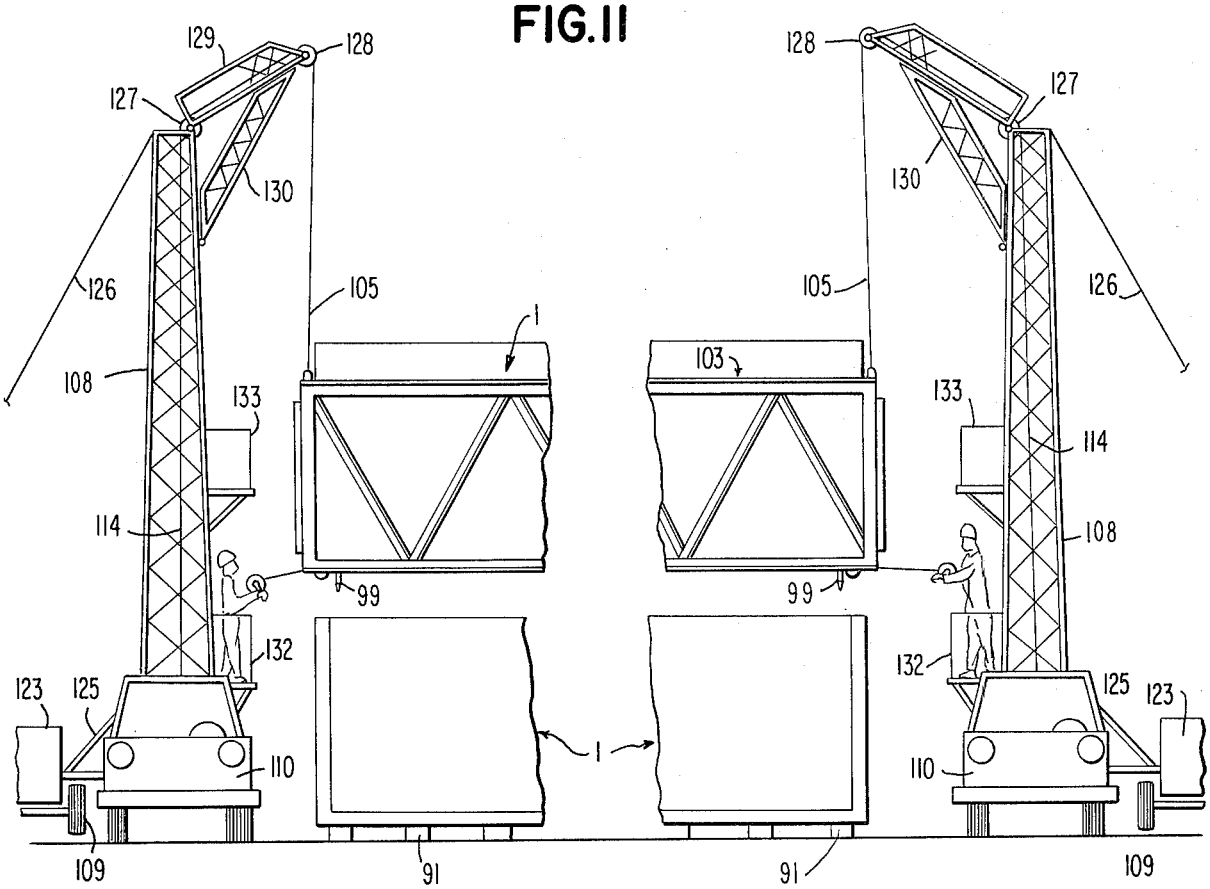
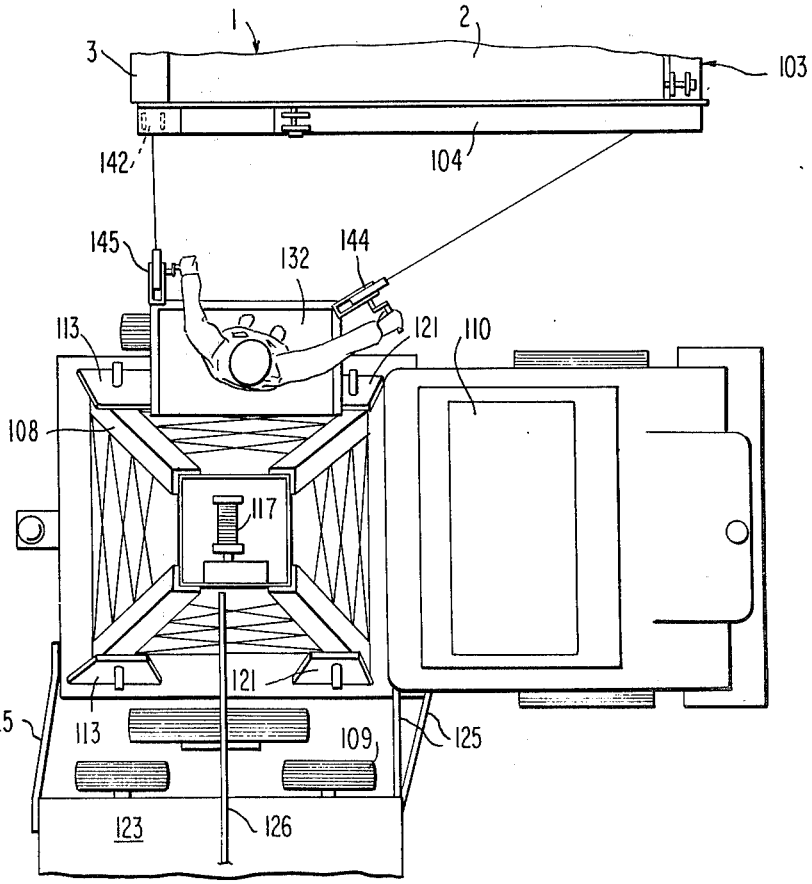
FIG.12

FIG.13
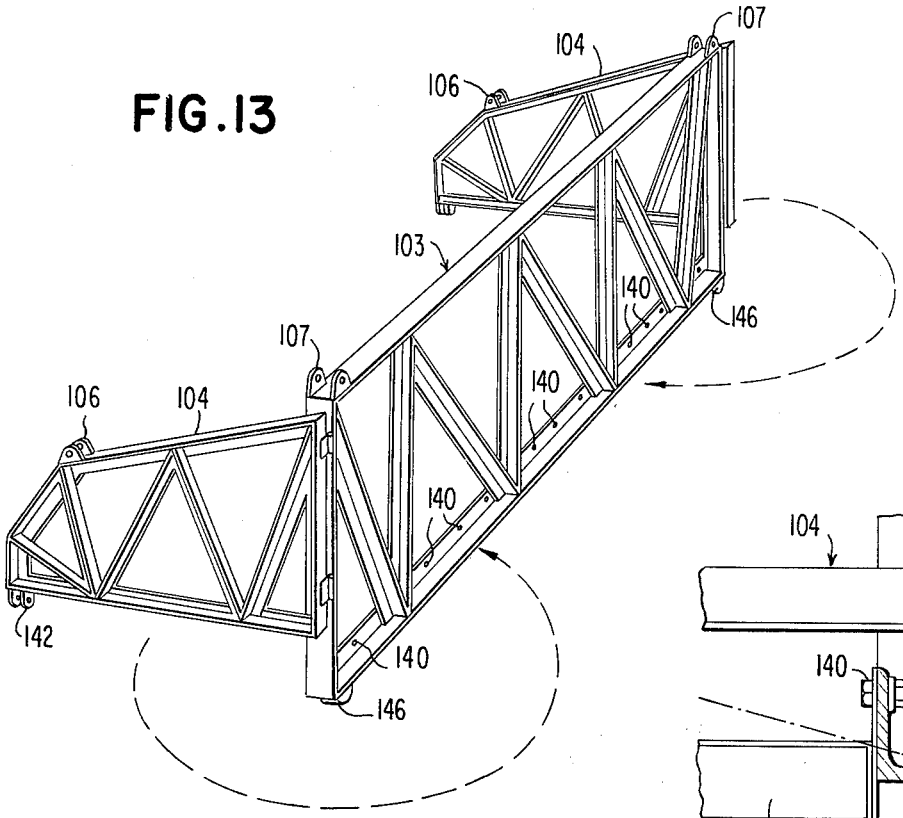
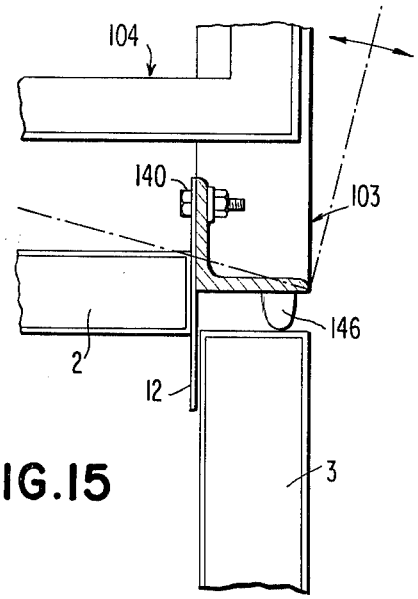
FIG.15
FIG.14
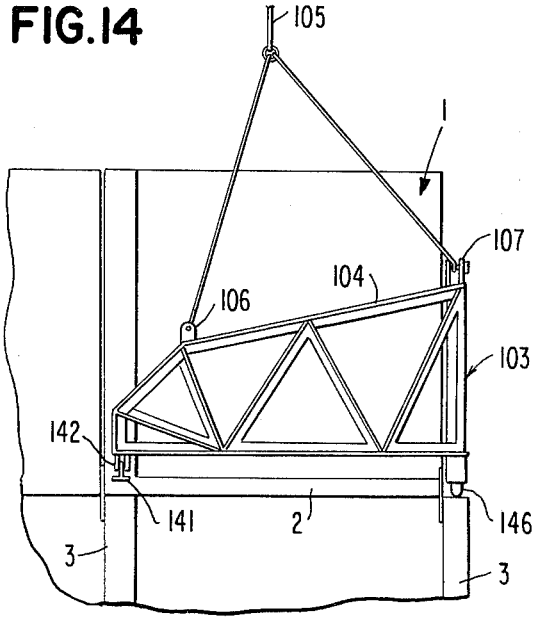
FIG.16
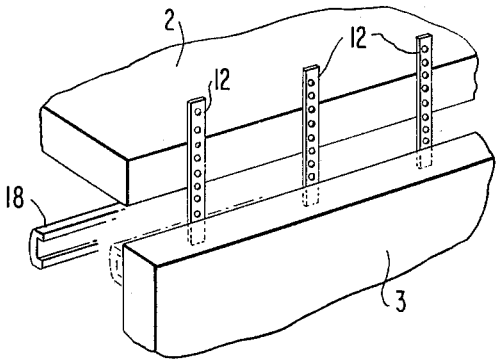

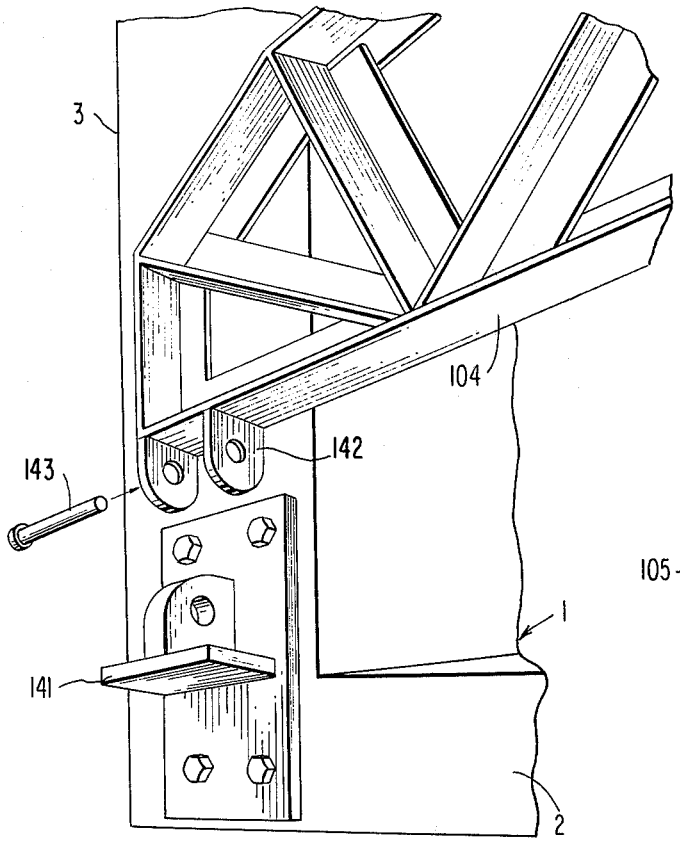
FIG. 17
FIG. 19
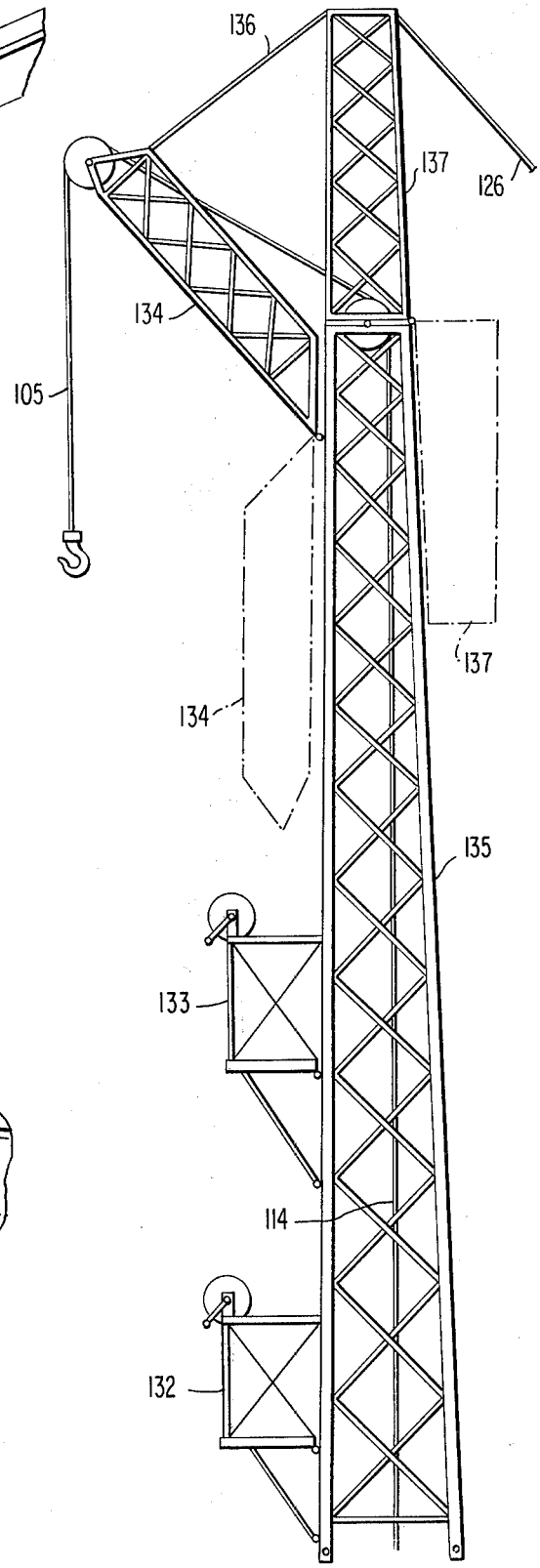
FIG. 18
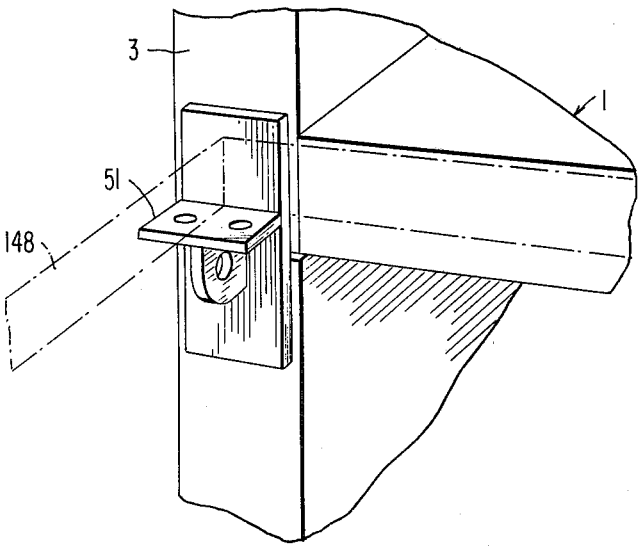

APPARATUS FOR TRANSPORTING AND ERECTING MODULAR HOUSING SYSTEM

This application is a division of prior copending application S.N. 395,517, filed Sept. 10, 1973 for MODULAR HOUSING STRUCTURE, now U.S. Pat. No. 3,881,283 issued May 6, 1975.

BACKGROUND OF THE INVENTION

The need for economical multi-unit housing which can be quickly constructed at any chosen location with minimum labor and material costs is so obvious and so widely known as to scarcely require emphasis or restatement. Numerous proposals have been advanced in recent years to provide low cost housing particularly for those in the low income levels. The United States Government, certain foreign governments, and private industry have repeatedly offered to reward those who can come forward with practical housing systems of the type so urgently needed in many urban areas. In response to the recognized need and the opportunities for reward, many meritorious construction systems have been proposed including prefabricated housing units and modular systems of a variety of types. A large number of United States and foreign patents have been granted in recent years on housing and building construction systems designed to meet the above-stated need. However, thus far, no system of this type has been widely adopted and recognized as ideal although many have been tried out on a regional basis or local basis with varying degrees of acceptance.

With this background in mind, the present invention has been made with the objective of totally satisfying the need for a particular type of low cost housing required by a large segment of the population on an immediate basis. If urban renewal projects are to succeed in any reasonable time and so-called ghettos are to be eliminated, there must be made available at low cost, comfortable and efficient dwelling space for families in the form of multiple housing units which can be quickly manufactured, transported to the desired location, and erected in the shortest possible time with a minimum amount of labor. Such housing, to satisfy the need of the day, must obviously be attractive and comfortable as well as strong and durable and resistant to the elements and therefore long-lasting. It must possess the modern facilities and features which all present-day citizens expect and desire even in the lowest cost accommodations including Government sponsored housing projects. Presently available housing and construction techniques have fallen far short of satisfying the needs and requirements, and as stated, the objective of the invention herein is to do so.

The invention provides a means for dealing with all of the principal problems or phases involved in the provision of low cost multi-level plural unit building construction. A basic housing module has been conceived which may be factory-constructed and outfitted with all basic components, partitions and utilities prior to shipment. Special transporting equipment has been created to move the relatively large modules to the construction site with maximum safely and efficiency and in conformity with highway regulations. Tower transporting equipment has been made easily convertible at the construction site into simplified crane apparatus for erecting the desired multiple level apartment house or the like in a most expeditious and economical way. Additionally, the invention embodies an efficient and economical foundation to receive the housing modules and simplified means for securely attaching the modules to one another during the erection process and for attaching the lower tier of modules to the foundation units.

Other features and advantages of the invention will become apparent during the course of the following detailed description.

DESCRIPTION OF DRAWING FIGURES

FIG. 1 is an end elevation of an L-module and transporter trailer.

FIG. 2 is a perspective view of the transporter trailer.

FIG. 3 is a side elevation of the transporter trailer and module coupled to a towing vehicle.

FIG. 4 is a plan view a tractor truck and tower convertible into a simplified construction crane.

FIG. 5 is a side elevation thereof.

FIG. 11 is a side elevation, partly broken away, showing a pair of simplified construction cranes used in the erection of a multi-story building and illustrating the lifting and positioning of a housing unit or module.

FIG. 12 is a fragmentary plan view of the equipment shown in FIG. 11.

FIG. 13 is a perspective view of a three part module lifting truss or brace.

FIG. 14 is an end elevational view of the truss in FIG. 13 as employed to position one of the L-modules.

FIG. 15 is an enlarged fragmentary vertical section showing the connection of the truss to the floor of one module and showing the truss in relation to an underlying wall of another module.

FIG. 16 is a fragmentary perspective view of adjacent L-modules as depicted in FIG. 15.

FIG. 17 is an exploded perspective view of a transverse truss member in relation to an L-module and positive connecting means.

FIG. 18 is a fragmentary perspective view of connecting means for a porch slab.

FIG. 19 is a side elevational view of a modified form of simplified construction crane.

DETAILED DESCRIPTION

Figure 6:
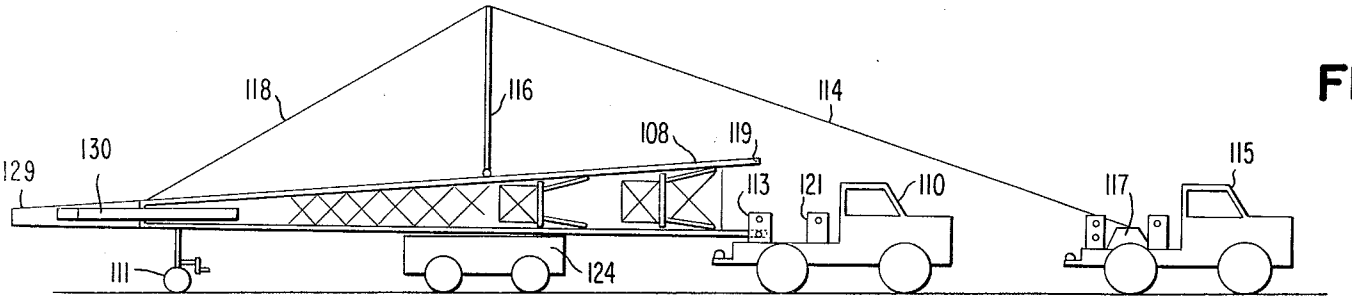
FIG. 6 is a side elevation of the equipment in FIGS. 4 and 5 with the tractor truck coupled to the tower base and an additional tractor truck positioned to erect the tower.
Figure 7:
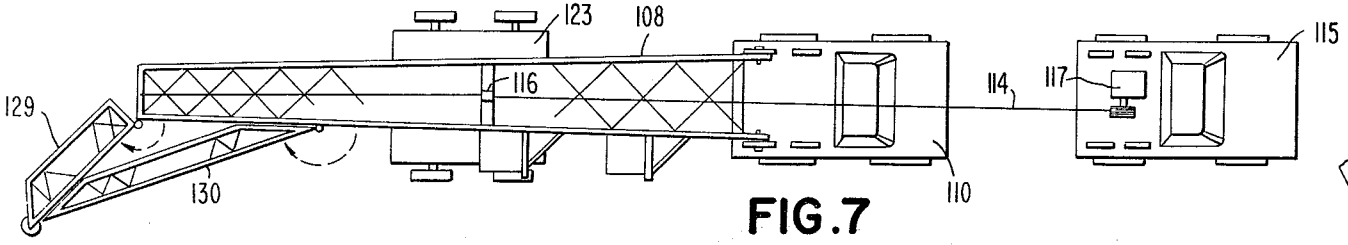
FIG. 7 is a plan view of the equipment in FIG. 26.
Figure 9:
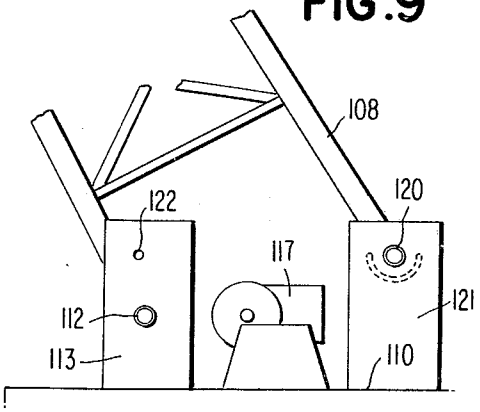
FIG. 9 is an enlarged fragmentary elevation showing the tower base positioned in an intermediate position during erection.
Figure 10:
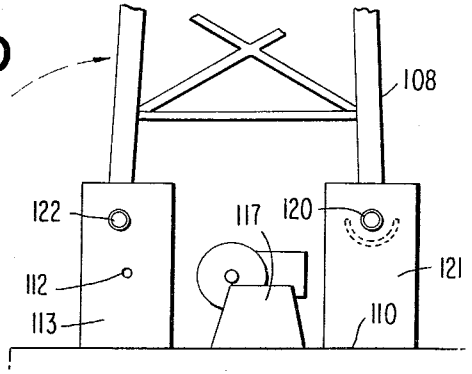
FIG. 10 is a similar fragmentary view of the tower base in the final erected position.

In the ensuing description, reference numerals employed to identify parts of a housing module and direct attachments thereto correspond to like numerals of reference in the prior Pender patent No. 3,881,283 which is incorporated herein by reference.

Referring to the drawings in detail, the numeral 1 designates a basically L-shaped housing module having horizontal wall 2 and vertical wall 3 and being constructed in a factory in accordance with the disclosure of U.S. Pat. No. 3,881,283. After such construction or prefabrication, each housing module must be transported to a building construction site where a foundation has been prepared in a manner described in said patent.

The L-shaped housing module has a lateral dissymmetry and inherent weight unbalance which presents a problem in transporting the module over a highway. To deal with this problem, a heavy duty mobile home type trailer frame and wheel assembly is modified so that the vertical wall 3 of the L-module rests directly over the left wheels 100 of the trailer unit designated 101 in FIGS. 1 to 3. During transport, the vertical wall 3 will be at or near the center of the highway and that portion of the floor or horizontal wall 2 in excess of the normal highway width will hang over the shoulder of the road. In other words, the outer side of the vertical wall 3 will be about four feet from the center of the trailer 101, whereas the longitudinal edge 102 of the floor 2 will be about eight feet from the center of the trailer. In the twelve foot wide module, therefore, the excess width beyond the standard eight feet will be allowed to overhang the shoulder of the road. This will represent much less of a road hazard than a symmetrical twelve foot wide load by virtue of the shoulder overhang arrangement. Additionally, the weight of the module 1 on the modified trailer frame will be approximately balanced because the weight is concentrated toward the vertical wall 3 and the center of gravity of the outfitted unit will be near the center line of the trailer.

A principal feature of the invention resides in the method of erecting a multi-story apartment building from the L-modules 1 utilizing two specialized cranes, to be described. In the lifting and erecting process, the vertical wall 3 of the module is utilized as a truss to support the weight of the module while a separable auxiliary truss 103 is conjointly used to support the other side of the L-module which lacks a vertical wall. As depicted in FIGS. 13 and 14, during the erection process, the truss forming wall 3 of the module 1 and the auxiliary longitudinal truss 103 are joined by hinged transverse end trusses 104 to form a box-like lifting cage for each module which is extremely rigid and stable. The L-module 1 is lifted at its opposite ends, FIGS. 13 and 14, by the vertical lift cables 105 of the two cranes, to be described, the ends of such cables being attached to lifting points 106 and 107, as indicated in the drawings. With the use of a two crane lifting and erecting system, a highly simplified and highly specialized crane can be advantageously used instead of a more complex and costly general purpose crane.

By utilizing a two crane system, the costly turntable and vertically swingable boom of the conventional crane is entirely eliminated. Each crane in essence is simply a fixed tower mounted on a tractor truck for locomotion. The crane has a simple counterweight arrangement to compensate for the overhang of the load. A conventional truck-mounted winch with cable threaded through pulleys on the tower easily convert the truck-mounted tower to a specialized crane at the job site.

Continuing to refer to the drawings and in particular to FIGS. 4 through 10, the crane tower 108 in effect is the frame for the trailer during road transit of the crane apparatus. The wheel and axle unit 109 used to transport the crane tower 108 becomes a counterweight assembly when the erected crane is in use at the building site, as will be described in detail. Also at the building site, the tractor truck 110 utilized to move the tower 108 becomes the base of the crane and the means for moving the lifted L-modules into place, as shown in FIGS. 31 and 32. The wheels of the tractor truck 110 are substituted for the usual crane turntable and vertically movable boom as the means for transferring the load at the building site.

In order to assemble the specialized crane, FIGS. 4 through 10, the tower 108 is first uncoupled from the tractor truck 110. The tractor truck is then driven around to the opposite end of the tower (the base of the tower) and backed up to the tower base. The height of the tower base attachment holes is now adjusted by the use of a built-in jack device 111, FIG. 26, until such holes coincide with the lower holes 112, FIG. 9, formed in the rear tower base plates 113 on the bed of the tractor truck 110. Pins are now inserted through these aligned holes to form a pivotal connection while the tower 108 is still horizontal.

Figure 8:
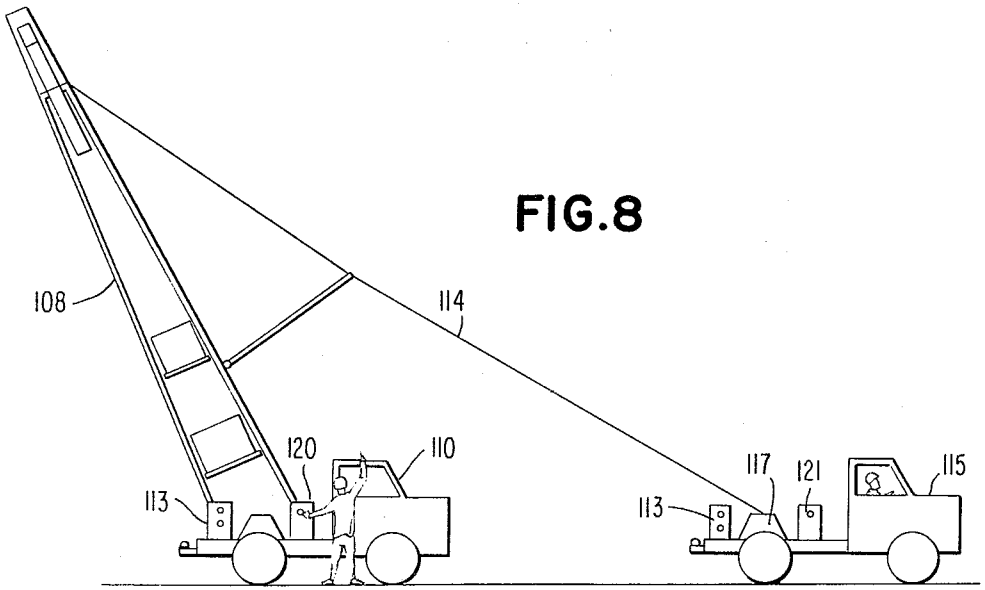
FIG. 8 is a fragmentary side elevation depicting a first step in the erection of the tower.

The next procedure is to utilize the winch cable 114 of the second trailer truck 115 on the job site and attach it to a tower erecting pole 116 and wind in the cable on the drum of winch 117. This will tilt the pole 116 which has another cable section 118 atached to the top of the tower 108. This procedure will start to pull the crane tower 108 toward an upright position as illustrated in FIG. 8. When the tower is tilted to the point where its center of gravity is slightly to the left of the rear support plate 113, the forward tower base holes 119 will register with corresponding holes 120 in forward tower base support plates 121 on the tractor truck 110, FIG. 9. Pins are now placed in the registering sets of holes to connect the tower base to the support plates 121. Now the winch 117 is operated to pull the towr 108 slightly forwardly to relieve pressure on the pivot pins in the opening 112. These pins are now removed and the tower is pulled to the final upright position, FIG. 10, where the holes in the rear side of the tower base register with the top holes 122 of the rear tower base plates 113. The pins are re-introduced through the aligned holes to secure the tower rigidly in the upright use position. The unique pin changing system described above controls the tower at all times and prevents the forward tower base from crashing into the forward tower base support plates 121 as soon as the tower center of gravity moves beyond or to the right of the rearward openings 112.

Following the erection of the tower 108, the wheel and axle unit 109 with extra weights 123 and 124 is pulled around to the outer side of the tower base and is anchored to the tractor truck 110 via a coupling 125 at each end of the counterweight unit, and a cable 126 is connected from the top of the tower 108 to the outer side of the counterweight unit, as shown in FIGS. 11 and 12. The load counterweight unit rolls along with the tractor truck 110 when the particular L-module 1 is being moved at the construction site. To lower and disassemble the crane tower, the reverse of the procedure described above is followed. When one crane tower is erected on one tractor truck 110, this tower can be utilized to erect the like tower on the other tractor truck. The procedure is identical except for the fact that the second erected tower will not require the erector pole 116.

The cable 114 from truck winch 117 is now threaded through pulleys 127 and 128, FIG. 11, the latter pulley being located at the tip of a fixed boom 129 on the tower 108 supported by a compression member 130. Each crane, as shown in FIG. 11, has a pair of operator platforms 132 and 133 located at different heights on its interior side to aid the operator in the proper placement of the L-modules 1 in the erection of the multi story building.

A modification of the specialized crane is shown in FIG. 19, wherein a fold-out boom 134 at the top of the tower 135 is supported by a tension cable 136 rather than by the compression member 130, as in FIG. 31. The cable 136 is attached to the top of a folding upper section 137 of the tower which is shown in the erected use position in full lines in FIG. 19 and is shown in the folded or non-use position in broken lines. The cable extending to the counterweight means 109-123 is shown at 138 in FIG. 19 and the previously-described worker platforms 132 and 133 are also indicated. In all other respects, the construction and operation of the modified crane corresponds to the previously-described arrangement in FIG. 11. The preferred embodiment for the crane is that shown in FIG. 19 where the boom 134 is supported by a tension cable, although either form is satisfactory.

With respect to the specialized twin cranes used in erecting the modular building, the following additional explanation is offered. The specialized cranes can be much simpler in construction where they are employed to do only one specialized job. The crane has a very short boom or overhang for its load, and since it has no turntable and no vertically movable boom, it must utilize its wheels on the tractor truck 110 to move the load between two points, and for practical purposes, the load must be moved in a general straight line. The length of the specialized load, namely the L-module 1, requires the cranes to be used in pairs as shown in FIG. 11.

By comparison, the conventional mobile crane does not utilize its wheels to move the load. The wheels are usually jacked up on built-in outrigger jacks and the load is moved by a combination of movements of the turntable and vertically swingable boom which may also be a telescopic boom. The conventional crane appears to be a much more expensive way to move the load in comparison to moving it on wheels in the particular application of this invention. The described wheel-mounted counterbalance means 109-123 which move along in either direction with the tractor trucks 110 facilitates the efficient handling of the L-module 1 by the two specialized cranes. The problem of counterweights being too heavy and tending to tip the cranes over backwards never arises since the counterweights are ground supported by their own wheels.

Although the crane itself is specialized, several of its components have general utility. In particular, the tractor truck 110 is a conventional mobile home mover and can still be used for this purpose, with the slight modifications of the truck causing no interference with conventional usage. Also the truck-mounted winch can be used for many purposes, amounting to multiplexing of the equipment. Similarly, the use of the wheel or dolly unit 109 as a counterweight further evidences the flexibility of the equipment.

In the actual modular building erection process utilizing the two specialized cranes, the following steps take place:

1. The L-module 1 is transported up to one side of the construction site or parallel to the front-to-back rows of foundation pillows, referring to FIG. 11. The L-module is parallel to, but spaced from, one side of the foundation pillows on which it is to rest in the completed building.

2. Referring to FIG. 3, the tractor truck 115 is uncoupled from the transporting trailer 101 and moved forwardly out of the way.

3. As shown in FIG. 1, a jack 139 is placed under the overhanging side of the module 1 near each end of the module and adjusted until the top of the jack is flush with the bottom of the horizontal wall 2.

4. The two specialized cranes are now backed up into position at the opposite ends of the L-module 1. The two cranes are supporting the previously-described lifting truss 103-104 shown in FIG. 13 at the attachment points 107, FIG. 13.

5. At this time, the longitudinal truss 103 is lowered by the two cranes to the tops of the jacks 139, FIG. 1, and the truss is slid gently inwardly toward the L-module 1 so that floor support pins 140 on the longitudinal truss 103 may enter top holes of the metal strap anchors 12 at the overhanging edge of the floor 2, such engagement being shown in FIG. 15.

6. The transverse or lateral truss members 104 hinged to the ends of the longitudinal truss 103 are now swung into position at the ends of the L-module, FIG. 14, and are securely pinned to the ends of the module wall 3 by means of attachment brackets 141 on the ends of the module and interfitting apertured lugs 142 on the truss sections 104. These interfitting elements receive removable locking pins 143 to stabilize the assembly.

7. Still referring to FIG. 14, the second branch of each cable 105 is now attached at 106 to the top outer end of each lateral truss member 104. At this time, the cable must be relieved of load to allow ready attachment of its left branch at the attachment point 106.

8. Utilizing the two cranes, the L-module 1 is now lifted bodily from the transporting trailer 101.

9. Referring to FIGS. 11 and 12, the cables of lateral and longitudinal load stabilizing winches 144 and 145 are now attached to the opposite ends of the L-module. These manipulating cables are actually connected to some convenient structural portion of the attactment truss 103 or 104. Operators on the platforms 132 and 133 are enabled to make fine adjustments in the longitudinal and lateral positioning of the L-modules by manually manipulating the winches 144 and 145.

10. Both cranes are now driven forwardly in unison while supporting the module 1 until this module is slightly forwardly of the foundation pillows on which it is to rest, it being understood that the two cranes are disposed at the front and back of the building site and are traveling across the front-to-back rows of foundation pillows 91.

11. At this time, the cement mixture is introduced into the recesses 97 of the foundation pillows, which recesses are to receive the metal strap anchors, 12 and **12*a*** as shown in U.S. Pat. No. 3,881,283

12. The module 1 is now carefully lowered onto the foundation utilizing the lateral and longitudinal adjusting and stabilizing winches 144 and 145 as the lowering procedure with the main cables 105 under control of the power winches 117 takes place. By having the cranes pull the module slightly forwardly of the formation pillows, the lateral winches 144 can be used to pull the module back precisely over the pillows. One operator on the appropriate crane platform of each crane is positioned so that he has an eye-level view of the operation, FIG. 11. Suitable controls for the power winches 117 could be located on the crane platforms or in the cabs of tractor trucks 110 with a suitable communication system between the operators.

13. The tapering locator pins 99 near the ends of the L-module 1 are now guided into the locator recesses 98 of the rearmost and forwardmost foundation pillows in the particular front-to-back rows of pillows. If needed, shims may be utilized to compensate for small discrepancies in the heights of foundation pillows as disclosed in said patent.

14. The preceding describes the placement of the lower four L-modules of the building. The placement of the second floor modules is similar except that the positioning pins 99 of the second floor modules enter into holes in the top edge of the vertical wall 3 of the module immediately below.

15. When each L-module is set into place, the pins 143 are removed, and referring to FIG. 14 the right branch of the cable 105 is detached from the longitudinal truss 103. The lateral truss members 104 are now enabled to act as fulcrum arms to tilt the longitudinal truss 103 when raised or lowered by the left branches of cable 105 attached at 106. This lever or fulcrum when utilized in conjunction with offset pivot points 146 on the lower corners of longitudinal truss 103 allow the making of minor height adjustments of the right hand end of the L-module floor 2, which in turn changes the angle of the vertical wall 3. Such tilting is shown on an exaggerated scale in FIG. 15 for the sake of illustration. This tilting action is used to make precise adjustments in the distance between the tops of walls 3 so that the subsequent placement of upper story L-modules will be accurate.

16. When the L-module 1 is exactly positioned, the metal strap anchors 12 can be screwed into place or attached to the vertical wall 3 of the underlying L-module and all molding 18, FIG. 16, may be applied. At the same time, the metal strap anchors 12*a* depending below the floor 2, FIGS. 7 and 17, of said patent are attached with screws to the vertical wall 3 immediately below. Additionally, the upper extremities of the strap anchors 12′, FIG. 7, of the previously-placed L module are attached by the screws 14 near the bottom of the adjoining wall 3.

17. Referring to FIG. 14, when the right end of floor 2 has been attached by the metal strap anchors 4 to the wall 3 below and when the molding 18 has been applied for the floor to rest upon, the truss lever arm 104 are lowered by the cable 105 attached at points 106 which relieves the load on the pins 140 of longitudinal truss 103 that have been supporting the floor 2. With no load on these pins 140, the top parts of metal strap anchors 12 are bent back out of the way of these pins.

18. The right branches of lifter cable 105 are now reattached at 107 to the longitudinal truss 103 and the left branches are detached at 106 to allow the lateral trusses 104 to swing back out of the way until they lie folded against and parallel to the longitudinal truss as indicated by the arrows in FIG. 13. The longitudinal truss is now lifted and the tractor truck mounted cranes are backed up to where the next L-module is waiting on its trailer 101, and the process is repeated.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. Apparatus for use in constructing plural level dwellings formed from a plurality of prefabricated basically L-shaped modules each having a single vertical wall and a bottom horizontal wall, said apparatus comprising twin wheel mounted construction cranes having relatively short fixed angle booms projecting from corresponding sides of the cranes, wheeled counterweighting means detachably coupled with the sides of the frames remote from their booms, winch operated lifting cables for said cranes trained over the outward ends of said booms, said twin cranes arranged for parallel traversing near opposite ends of a housing module, and a lifting truss connected with said cables of the crane and adapted to be temporarily attached to a housing module at the side thereof remote from the module vertical wall and thereby forming with that module a rigid structure capable of withstanding stresses caused by lifting, transporting and placement of the module by said twin cranes, said lifting truss comprising a main longitudinal truss section which is substantially coextensive lengthwise with the module being lifted and a pair of hinged end transverse truss sections on the longitudinal truss section adapted to span opposite ends of the housing module and be coupled thereto.

2. The structure of claim 1, and said construction cranes each embodying a main tower, a tractor truck adapted to tow said tower to a construction site, a wheeled support unit for the tower while the latter is being towed and adapted to be subsequently coupled to said tractor truck to serve as a counterweight for the crane during the use of the crane at a construction site, cooperative means including a second tractor truck to erect the crane tower to a use position on the first-named tractor truck at the construction site after the first-named tractor truck has been pivotally coupled to the base of the tower, and a side operator platform on each crane tower and being equipped with a pair of manually operable lateral and longitudinal fine adjustment winches having cable means attachable to said auxiliary lifting truss.

3. The structure of claim 1, wherein each of said cranes is a fixed radius crane having a main tower supporting said short fixed angle boom and said main tower attached fixedly to a motorized truck base without provision for sluing or luffing, and said wheeled counterweighting means comprising a trailer vehicle adapted to support said main tower during roadway transport with the tower in a down position on said trailer vehicle and with one end of the tower coupled to said motorized truck base which then serves as a towing vehicle for the tower on said trailer vehicle.

4. The structure of claim 3, and said motorized truck base comprising cable winch means for use in erecting said main tower on said truck base and for subsequently manipulating said modules, and main tower base support plates on said truck base to which said tower may be releasably coupled in an upright use position following transporting of the tower by said truck base to a site of use.

5. The structure of claim 4, and said main tower having fore and aft pairs of legs, said tower base support plates comprising fore and aft pairs of upstanding support plates fixed to said truck base, said aft pair of support plates having first and second pairs of aligned coupling pin apertures at two elevations, and the fore pair of support plates having a single pair of aligned coupling pin apertures at the elevation of the uppermost apertures in the aft pair of support plates, whereby the aft legs of the main tower may first be coupled to the aft support plates at a lower elevation and the tower pivoted for coupling its fore legs to the fore support plates, followed by rocking of the tower upwardly on the fore support plates and coupling its aft legss to the aft support plates at an upper elevation thereon.

6. The structure of claim 5, and a tower erecting brace member pivotally attached to one side of said main tower intermediate the ends of the latter to assist in winching the main tower pivotally to an upright position on said truck base following attachment of the aft tower legs to said aft support plates at said lower elevation thereon.

7. The structure of claim 1, and worker platforms on the interior opposing sides of said twin cranes and a pair of lateral and longitudinal load adjusting and stabilizing winches on each worker platform including separate manually controllable load adjustment cables attachable to each module near opposite ends of the latter.

* * * * *